US008312942B2

(12) United States Patent
Ho et al.

(10) Patent No.: US 8,312,942 B2
(45) Date of Patent: Nov. 20, 2012

(54) ROLLER CONE DRILL BITS WITH IMPROVED FLUID FLOW

(75) Inventors: Tuck L. Ho, Houston, TX (US); Micheal B. Crawford, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 397 days.

(21) Appl. No.: 12/439,433

(22) PCT Filed: Aug. 31, 2007

(86) PCT No.: PCT/US2007/077390

§ 371 (c)(1),
(2), (4) Date: Dec. 21, 2009

(87) PCT Pub. No.: WO2008/028131

PCT Pub. Date: Mar. 6, 2008

(65) Prior Publication Data

US 2010/0089656 A1 Apr. 15, 2010

Related U.S. Application Data

(60) Provisional application No. 60/824,374, filed on Sep. 1, 2006, provisional application No. 60/828,337, filed on Oct. 5, 2006.

(51) Int. Cl.
*E21B 10/08* (2006.01)
*E21B 10/18* (2006.01)
*E21B 10/44* (2006.01)

(52) U.S. Cl. ..... 175/331; 175/336; 175/339; 175/340; 175/394

(58) Field of Classification Search ..... 175/331, 175/336, 339, 340, 394, 354
See application file for complete search history.

(56) References Cited

U.S. PATENT DOCUMENTS

| | | | | |
|---|---|---|---|---|
| 2,634,105 | A * | 4/1953 | Gruner | 175/341 |
| 3,420,324 | A * | 1/1969 | Vesper | 175/339 |
| 4,054,772 | A | 10/1977 | Lichte | 219/121 EM |
| 4,056,153 | A | 11/1977 | Miglierini | 175/376 |
| 4,280,571 | A | 7/1981 | Fuller | 175/337 |
| 5,439,068 | A * | 8/1995 | Huffstutler et al. | 175/356 |
| 5,531,681 | A | 7/1996 | Walton et al. | 604/83 |
| 5,553,681 | A * | 9/1996 | Huffstutler et al. | 175/339 |
| 5,755,297 | A | 5/1998 | Young et al. | 175/331 |
| 6,296,067 | B1 | 10/2001 | Slaughter et al. | 175/228 |
| 7,059,430 | B2 | 6/2006 | Singh et al. | 175/339 |
| 2007/0163811 | A1 | 7/2007 | Gutmark et al. | 175/340 |

OTHER PUBLICATIONS

International Search Report and Written Opinion, PCT/US2007/77390, 7 pages, Mailed Apr. 1, 2008.
International Preliminary Report on Patentability; PCT/US2007/077390; pp. 6, Mar. 12, 2009.
Security DBS Drill Bits Technical Bulletin TB.09.06.01, 1 page, Sep. 6, 2001.

* cited by examiner

*Primary Examiner* — Cathleen Hutchins
(74) *Attorney, Agent, or Firm* — Baker Botts L.L.P.

(57) ABSTRACT

Roller cone drill bits operable to form a borehole. A number of support arms may extend from each drill bit. A cutter cone assembly may be mounted on each support arm. A number of cutting elements or inserts may be disposed on an exterior surface of a cone assembly. A lifting surface may be formed on each support arm extending between a leading edge and a trailing edge of each support arm such that the lifting surfaces directs cuttings upward in a borehole. A wedge shaped portion may be formed on each support arm proximate the lifting surface and the trailing edge. An inlet to each lifting surface may be formed on the leading edge of each support arm.

22 Claims, 4 Drawing Sheets

ROLLER CONE DRILL BITS WITH IMPROVED FLUID FLOW

CROSS-REFERENCE TO RELATED APPLICATION

This application is a U.S. national stage application of International Application No. PCT/US2007/77390 filed Aug. 31, 2007, which designates the United States of America, which claims the benefit of U.S. Provisional Patent Application Ser. No. 60/824,374 entitled "Roller Cone Drill Bit and Method for Improving Fluid Flow" filed Sep. 1, 2006, and further claims the benefit of U.S. Provisional Patent Application Ser. No. 60/828,337 entitled "Rotary Drill Bits and Other Downhole Tolls with Improved Fluid Flow" filed Oct. 5, 2006. The contents of which are hereby incorporated by reference in their entirety.

TECHNICAL FIELD

The present disclosure is related to roller cone drill bits and more particularly to improving fluid flow over exterior portion of such roller cone drill bits to lift formation cuttings and other downhole debris to an associated well surface during formation of a wellbore.

BACKGROUND OF THE DISCLOSURE

Various types of rotary drill bits, reamers, stabilizers and other downhole tools may be used to form a borehole in the earth. Examples of such rotary drill bits include, but not limited to, roller cone bits, rotary cone bits, rock bits, fixed cutter drill bits, drag bits, PDC drill bits and matrix drill bits used in drilling oil and gas wells. A typical rotary drill bit may include a bit body with an upper portion adapted for connection to a drill string. A plurality of support arms, typically three, depend from a lower portion of the bit body. Each arm generally includes a spindle which may protrude radially inward and downward with respect to a projected rotational axis of the bit body.

Conventional roller cone drill bits are typically constructed in three segments. The segments may be positioned together longitudinally with a welding groove between each segment. The segments may then be welded with each other using conventional techniques to form the bit body. Each segment also includes an associated support arm extending from the bit body. An enlarged cavity or passageway is typically formed in the bit body to receive drilling fluids from an attached drill string. U.S. Pat. No. 4,054,772 entitled "Positioning System for Rock Bit Welding" shows a method and apparatus for constructing a three cone rotary rock bit from three individual segments.

A cone assembly is generally mounted on each spindle and rotatably supported on bearings disposed between the spindle and a cavity formed in the cone assembly. One or more nozzles may be disposed in the bit body adjacent to the support arms. The nozzles are typically positioned to direct drilling fluid passing downwardly from the drill string through the bit body toward the bottom or end of a borehole being formed.

Drilling fluid is generally provided by the drill string to perform several functions including washing away material removed from the bottom of the borehole, cleaning the cone assemblies and associated cutting structures, and carrying formation cuttings radially outward and then upward within an annulus defined between the exterior of the bit body and the adjacent portions the borehole. U.S. Pat. No. 4,056,153 entitled, "Rotary Rock Bit with Multiple Row Coverage for Very Hard Formations" and U.S. Pat. No. 4,280,571 entitled, "Rock Bit" show examples of conventional roller cone bits with cutter cone assemblies mounted on a spindle projecting from a support arm.

U.S. Pat. No. 5,531,681 entitled "Rotary Cone Drill Bit With Angled Ramps" provides an example of a roller cone drill bit with enhanced fluid flow around exterior portions of the drill bit to remove formation cuttings and other debris from the bottom of a borehole to an associated well surface.

Pending U.S. patent application entitled "Rotary Drill Bit With Nozzles Designed To Enhance Hydraulic Performance And Drilling Fluid Efficiency", Ser. No. 11/466,252 filed Aug. 22, 2006 and published as U.S. Patent Publication No. 2007/0163811A1, noted the benefits of tightly controlled, upward directed fluid flow in a well annulus. Spiraling fluid flow may more effectively lift and remove formation cuttings and other downhole debris.

Prior rotary cone drill bits, including roller cone drill bits, often have support arms with generally symmetrical configurations relative to respective leading edges and trailing edges of such support arms. The trailing edge of prior support arms was often intentionally left open to facilitate cleaning associated cutting structures and removal of cuttings and other downhole debris.

SUMMARY

In accordance with teachings of the present disclosure, roller cone drill bits may be provided with lifting surfaces and/or trailing wedges to better guide fluid flow over exterior portions of such drill bits and between such drill bits and adjacent portions of a wellbore. Support arms associated with roller cone drill bits may cooperate with each other to generate an optimum spiral of fluid to entrain and lift formation cuttings and other downhole debris upward while minimizing build up of formation cuttings and other downhole debris adjacent to the drill bit. For some applications, such as roller cone drill bits having a diameter greater than approximately nine (9") inches, each lifting surface and/or trailing wedge may generate fluid lift equal to or greater than one (1") inch per three hundred sixty (360°) degrees of flow relative to exterior portions of the drill bit and/or an associated drill string. As a result spiraling flow paths may be formed in a well annulus with a lead of approximately four (4") inches per three hundred sixty (360°) degrees of rotation relative to the drill string. For smaller diameter drill bits the resulting fluid lift may be in the range of approximately 2.9 to 2.5 inches per ninety (90°) degrees of rotation relative to the drill string.

One aspect of the present disclosure may include forming a roller cone drill bit with support arms having a trailing wedge shape to assist with forming self regenerating fluid spirals or spiraling fluid paths in a direction opposite from bit rotation.

Spiraling fluid flow may optimize removal of formation cuttings and may significantly reduce recirculation of formation cuttings and other downhole debris around support arms and associated cone assemblies. Spiraling fluid paths may also reduce opportunities for formation cuttings and other downhole debris to adhere to exterior portions of a drill bit and clog fluid flow paths between adjacent portions of a bit body, cutting structures and/or portions of a wellbore. For some applications the leading edge of a trailing support arm may be "opened up" to provide an enlarged fluid flow area.

BRIEF DESCRIPTION OF THE DRAWINGS

A more complete and thorough understanding of various embodiments and advantages thereof may be acquired by referring to the following description taken in conjunction with accompanying drawings, in which like reference numbers indicate like features, and wherein.

DETAILED DESCRIPTION OF THE DISCLOSURE

Figure 1:
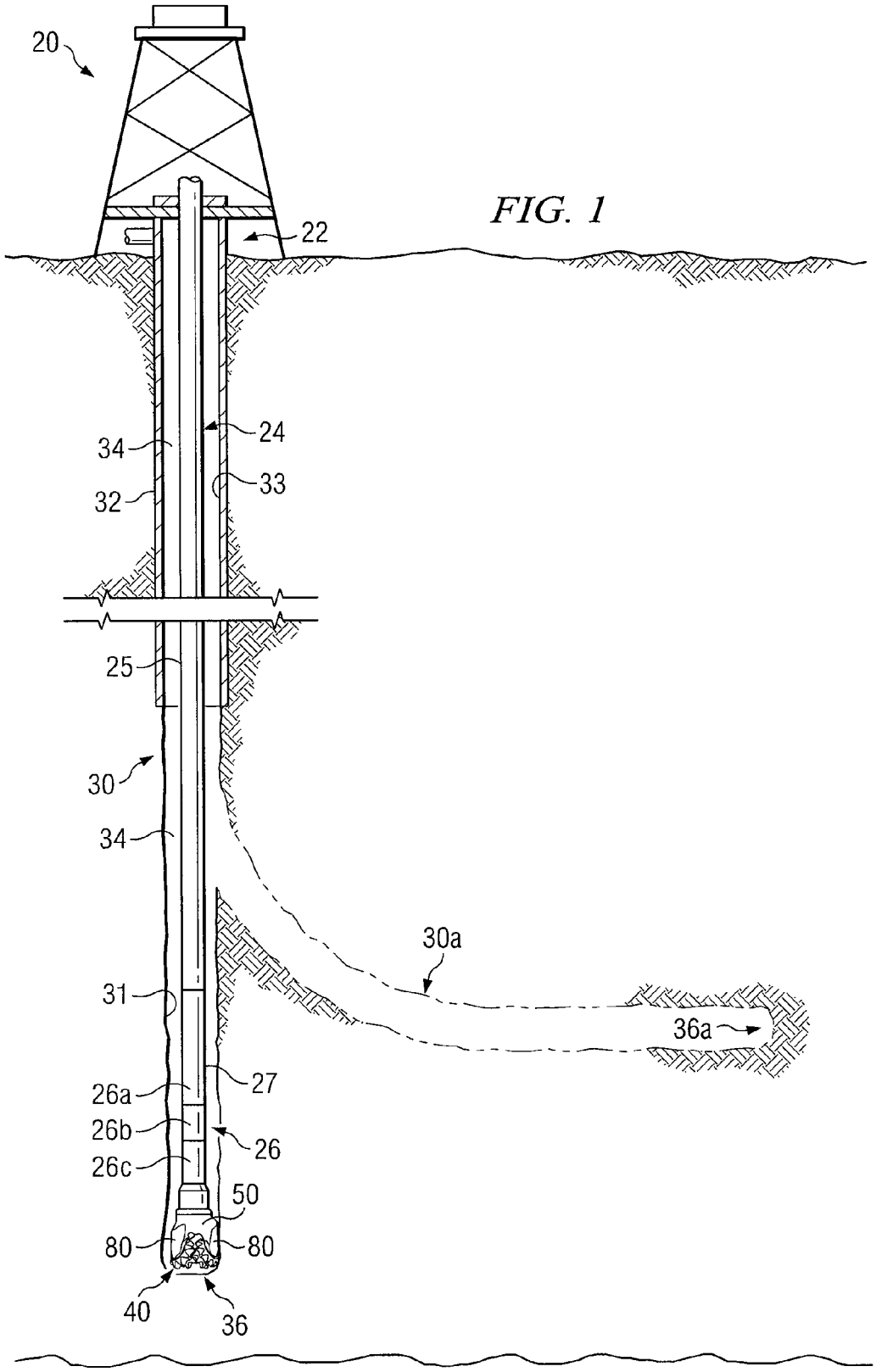
FIG. 1 is a schematic drawing in section and in elevation with portions broken away showing examples of wellbores which may be formed by a roller cone drill bit incorporating teachings of the present disclosure.

Preferred embodiments of the present disclosure and various advantages may be understood by referring to FIGS. 1-5 of the drawings. Like numerals may be used for like and corresponding parts in the various drawings.

Roller cone drill bits and associated support arms incorporating teachings of the present disclosure may have many different designs and configurations. Roller cone drill bit 40 and support arms 80 as shown in FIGS. 1-5 represent only one example of a roller cone drill bit and/or support arms which may be formed in accordance with teachings of the present disclosure.

The terms "cone assembly" and "cone assemblies" may be used in this application to include various types of cones, cutter cones and roller cones associated with roller cone drill bits. A cone assembly will typically include a generally circular backface with a generally conical shape extending therefrom. A plurality of cutting elements may be disposed on exterior portions of the conical shape.

The terms "cutting element" and "cutting elements" may be used in this application to include various types of compacts, cutters, inserts, milled teeth and/or welded compacts satisfactory for use with a wide variety of roller cone drill bits. Polycrystalline diamond compacts (PDC) and tungsten carbide inserts are often used to form cutting elements for roller cone drill bits. A wide variety of other types of hard, abrasive materials may also be used to form cutting elements for a roller cone drill bit.

The terms "cutting structure" and "cutting structures" may be used in this application to include various combinations and arrangements of cutting elements formed on or attached to one or more cone assemblies associated with roller cone drill bits. Cutting elements are often arranged in rows on exterior portions of a cone assembly or other exterior portions of downhole tools used to form a well bore.

The terms "drilling fluid" and "drilling fluids" may be used to describe various liquids and mixtures of liquids and suspended solids associated with well drilling techniques. Drilling fluids may be used for well control by maintaining desired fluid pressure equilibrium within a wellbore. The weight or density of drilling fluid is generally selected to prevent undesired fluid flow from an adjacent downhole formation into a wellbore and also to prevent undesired flow of the drilling fluid from the wellbore into adjacent downhole formations. Drilling fluids may also provide chemical stabilization for formation materials adjacent to a wellbore and may prevent or minimize corrosion of a drill string, bottom hole assembly and/or attached roller cone drill bit.

Some mixtures of liquids and suspended solids may be generally described as "drilling mud." However, some drilling fluids may be primarily liquids depending upon associated downhole drilling environments. For some special drilling techniques and downhole formations, air or other suitable gases may be used as a drilling fluid.

A wide variety of chemical compounds may be added to drilling fluids as appropriate for associated downhole drilling conditions and formation materials. The type of drilling fluid used to form a wellbore may be selected based on design characteristics of an associated roller cone drill bit, characteristics of anticipated downhole formations and hydrocarbons or other fluids produced by one or more downhole formations adjacent to the wellbore.

Drilling fluids may also be used to clean, cool and lubricate cutting elements, cutting structures and other components associated with a roller cone drill bit. Drilling fluids may assist in breaking away, abrading and/or eroding adjacent portions of a downhole formation.

FIG. 1 is a schematic drawing in elevation and in section with portions broken away showing examples of wellbores or bore holes which may be formed in accordance with teachings of the present disclosure. Various aspects of the present disclosure may be described with respect to drilling rig 20 rotating drill string 24 and attached roller cone drill bit 40 to form a wellbore.

Various types of drilling equipment such as a rotary table, mud pumps and mud tanks (not expressly shown) may be located at well surface or well site 22. Drilling rig 20 may have various characteristics and features associated with a "land drilling rig." However, roller cone drill bits incorporating teachings of the present disclosure may be satisfactorily used with drilling equipment located on offshore platforms, drill ships, semi-submersibles and drilling barges (not expressly shown).

Roller cone bit 40 as shown in FIGS. 1-4 may be attached to a wide variety of drill strings extending from an associated well surface. For some applications roller cone drill bit 40 may be attached to bottom hole assembly 26 at the extreme end of drill string 24. See FIG. 1. Drill string 24 may be formed from sections or joints of generally hollow, tubular drill pipe (not expressly shown). Bottom hole assembly 26 will generally have an outside diameter compatible with exterior portions of drill string 24.

Bottom hole assembly 26 may be formed from a wide variety of components. For example components 26*a*, 26*b* and 26*c* may be selected from the group consisting of, but not limited to, drill collars, rotary steering tools, directional drilling tools and/or downhole drilling motors. The number of components such as drill collars and different types of components included in a bottom hole assembly will depend upon anticipated downhole drilling conditions and the type of wellbore which will be formed by drill string 24 and roller cone drill bit 40.

Drill string 24 and roller cone drill bit 40 may be used to form a wide variety of wellbores and/or bore holes such as generally vertical wellbore 30 and/or generally horizontal wellbore 30*a* as shown in FIG. 1. Various directional drilling techniques and associated components of bottomhole assembly 26 may be used to form horizontal wellbore 30*a*.

Figure 2:
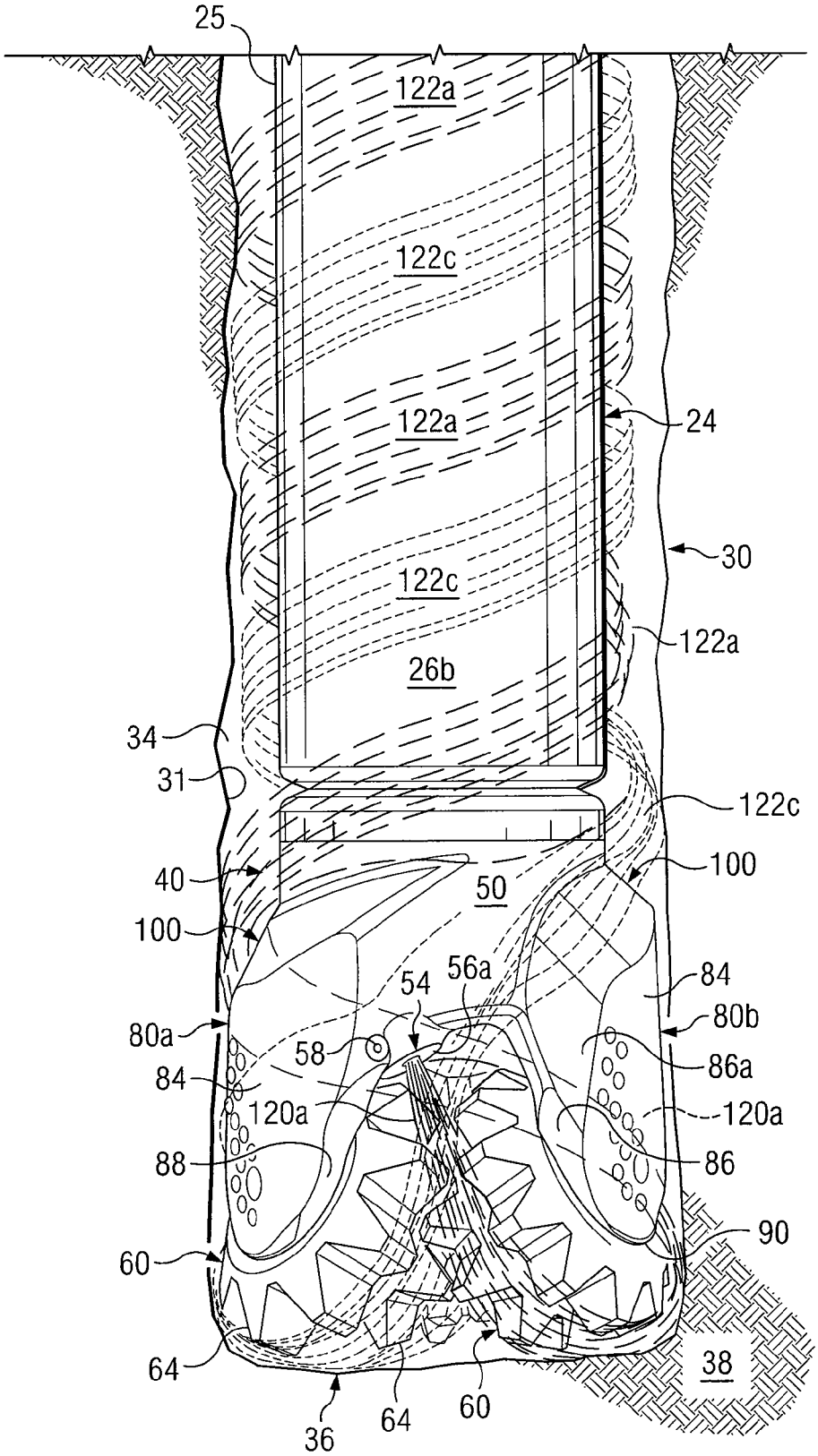
FIG. 2 is a schematic drawing in elevation and in section with portions broken away showing one example of a roller cone drill bit incorporating teachings of the present disclosure attached to one end of a drill string while forming a wellbore.

Wellbore 30 may be defined in part by casing string 32 extending from well surface 22 to a selected downhole location. Portions of wellbore 30 as shown in FIGS. 1 and 2, which do not include casing 32 may be described as "open hole". Various types of drilling fluid may be pumped from well surface 22 through drill string 24 to attached roller cone drill bit 40. The drilling fluid may be circulated back to well surface 22 through annulus 34 defined in part by outside diameter 25 of drill string 24 and inside diameter 31 of wellbore 30. Inside diameter 31 may also be referred to as the "sidewall" of wellbore 30. Annulus 34 may also be defined by outside diameter 25 of drill string 24 and inside diameter 31 of casing string 32.

Formation cuttings may be formed by roller cone drill bit 40 engaging formation materials proximate end 36 of wellbore 30. Drilling fluids may be used to remove formation cuttings and other downhole debris (not expressly shown) from end 36 of wellbore 30 to well surface 22. End 36 may sometimes be described as "bottom hole" 36. Formation cuttings may also be formed by roller cone drill bit 40 engaging end 36*a* of horizontal wellbore 30*a*.

While drilling with a conventional roller cone drill bit, fluid flow in the vicinity of cutting elements or cutting structures may be very turbulent and may inhibit or even prevent upward flow of formation cuttings and other downhole debris from the bottom or end of a wellbore. Furthermore, formation cuttings and other downhole debris may collect in locations with restricted fluid flow or areas of flow stagnation through an annulus extending to an associated well surface. Examples of such locations with restricted fluid flow may include lower portions of a bit body adjacent to respective cutting structures and an annulus area disposed between exterior portions of a bit body and adjacent portions of a wellbore. Other areas of restricted flow may include each backface of respective cone assemblies and the adjacent portions of a wellbore.

As a result of collecting formation cuttings and other downhole debris in such available areas for fluid flow, the velocity of fluid flow through such restricted areas may significantly increase and may increase erosion of adjacent components of a roller cone drill bit. Vital components such as bearings and seals (not expressly shown) may be exposed to drilling fluids, formation cuttings and other downhole debris which may lead to premature failure of the roller cone drill bit as such erosion progresses.

Formation cuttings and other downhole debris may be diverted back under portions of a cone assembly contacting the bottom or end of a wellbore. Such diversion results in the cone assembly "redrilling" the formation cuttings and other downhole debris which further wears associated cutting structures on the cone assembly and may reduce the penetration rate of the associated roller cone drill bit.

Various features of the present disclosure may substantially reduce or eliminate areas of stagnate fluid flow between exterior portions of a roller cone drill bit and adjacent portions of a wellbore as well as underneath associated cutting structures. The present disclosure may also prevent undesired changes in the velocity of fluid mixtures flowing in an annulus formed between a drill string and the sidewall of a wellbore. See for example well annulus 34 in FIGS. 1 and 2.

Roller cone drill bit 40 may include bit body 50 with support arms 80 and respective cone assemblies 60 extending therefrom. Bit body 50 may also include upper portion 42 with American Petroleum Institute (API) drill pipe threads 44 formed thereon. API threads 44 may be used to releasably engage roller cone drill bit 40 with bottomhole assembly 26 and to allow rotation of roller cone drill bit 40 in response to rotation of drill string 24 at well surface 22.

Figure 5:
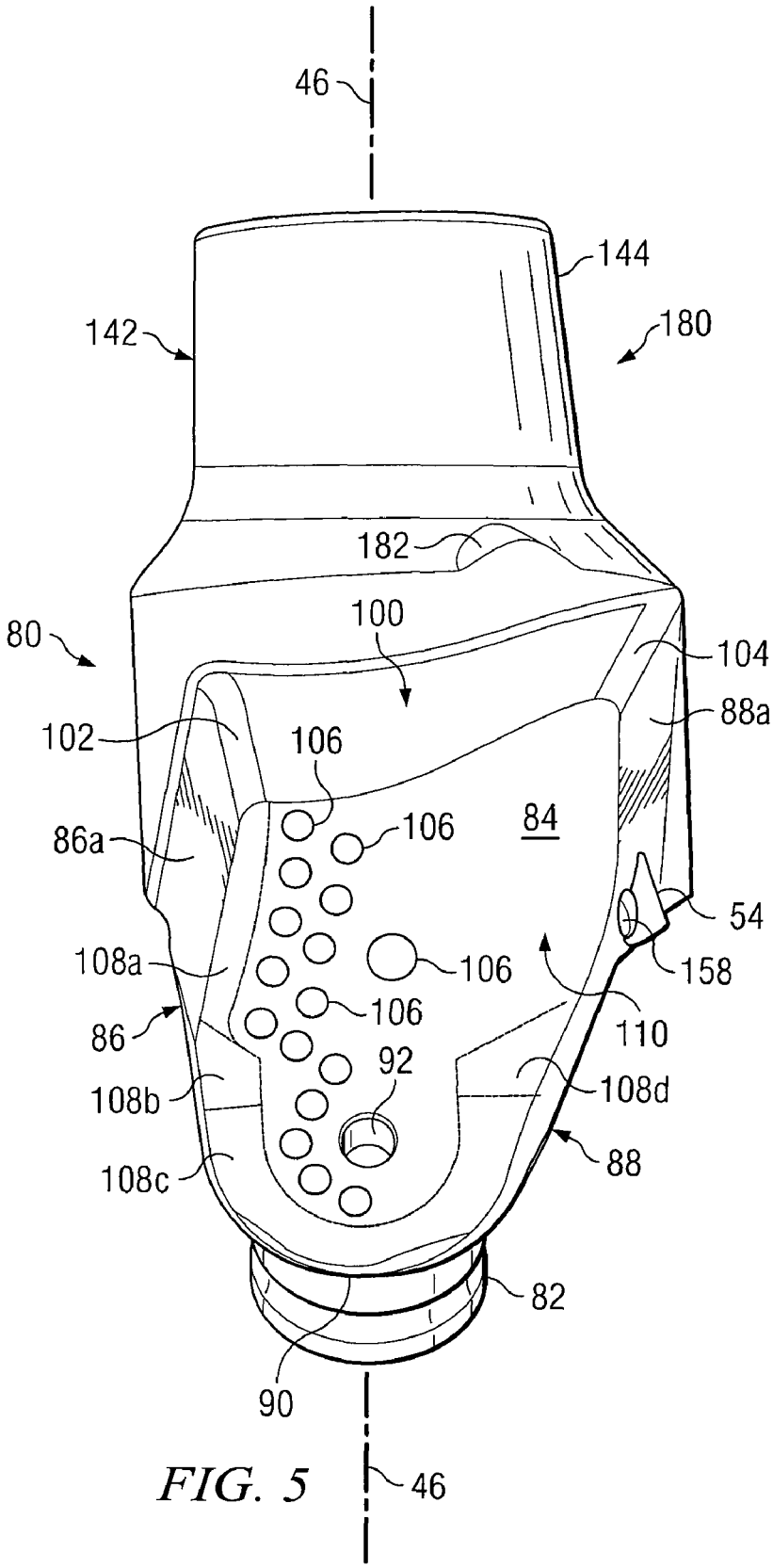
FIG. 5 is a schematic drawing in elevation showing one example of a segment of a roller cone drill bit having a support arm incorporating teachings of the present disclosure.

Roller cone drill bits, particularly hammer drill bits, are typically formed using three segments. See for example segment 180 as shown in FIG. 5. Segment 180 may represent one of three segments used to form portions of roller cone drill bit 40. Each segment 180 may include upper portion 142 with respective support arm 80 extending therefrom. Each upper portion 142 may form approximately one third of bit body 50 and associated upper portion 42. Segments 180 may be welded with each other using conventional techniques to form a bit body for roller cone drill bit. For example, notch 182 may be formed in exterior portions of segment 180 for use in aligning three segments 180 with each other in an appropriate welding fixture. Each notch 182 may be removed during machining of various surfaces associated with exterior portions of roller cone drill bit 40.

Figure 4:
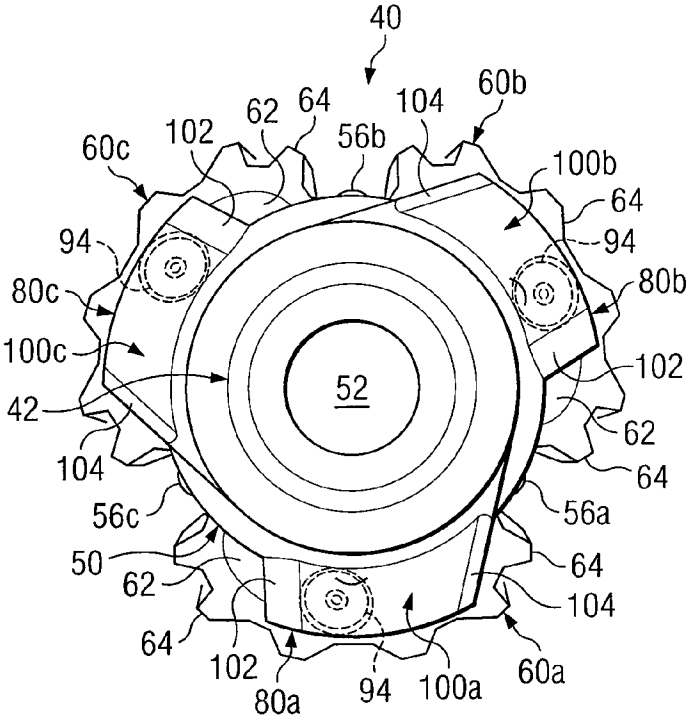
FIG. 4 is a plan view taken along lines 4-4 of FIG. 3.
Figure 3:
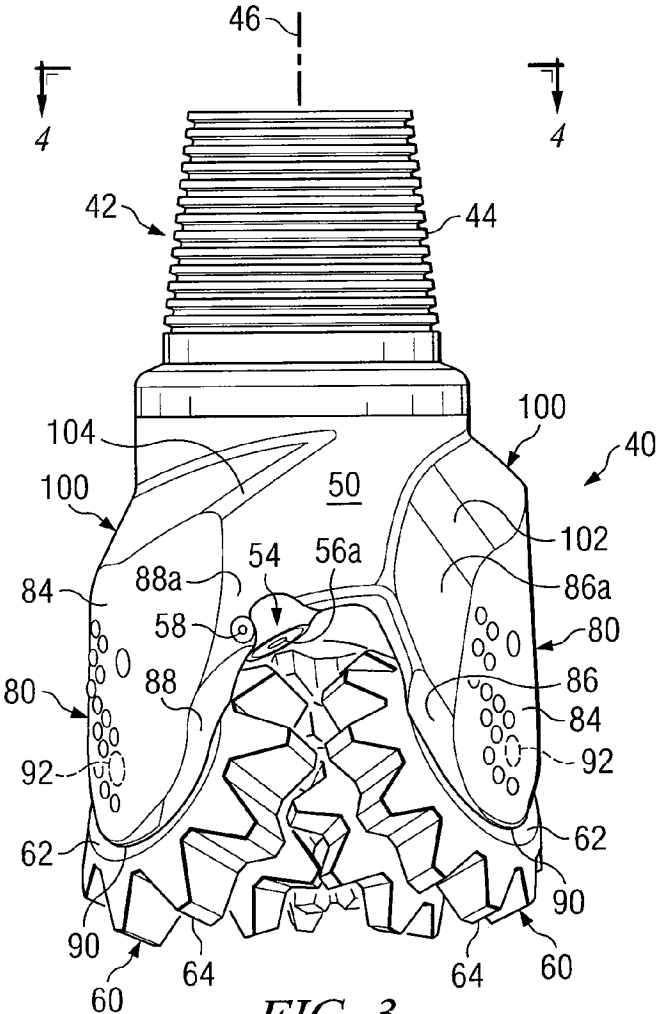
FIG. 3 is a schematic drawing showing an isometric view of a roller cone drill bit incorporating teachings of the present disclosure.

Enlarged cavity 52 as shown in FIG. 4 may be formed within bit body 50 extending through upper portion 42 to receive drilling fluid from drill string 24. One or more fluid flow passageways (not expressly shown) may also be formed in bit body 50 to direct fluid flow from enlarged cavity 52 to respective nozzle housings or receptacles 54.

One or more nozzle receptacles 54 may be formed in exterior portions of bit body 50. See FIGS. 2, 3 and 5. Each receptacle 54 may be sized to receive associated nozzle 56. Various types of locking mechanisms 58 may be used to securely engage each nozzle 56 in respective nozzle receptacle 54. For embodiments represented by segment 180 and support arm 80 as shown in FIG. 5, locking mechanism 58 may be inserted through hole 158 to securely engage associated nozzle 56 within nozzle housing or nozzle receptacle 54.

The lower portion of each support arm 80 may include spindle 82. See FIG. 5. Spindle 82 may also be referred to as "shaft" or "bearing pin." Cone assemblies 60 may be rotatably mounted on respective spindles 82 extending from support arms 80. Each cone assembly 60 may include a respective cone rotational axis (not expressly shown) corresponding generally with an angular relationship between each spindle 82 and associated support arm 80. The cone rotational axis of each cone assembly 60 may be offset relative to bit rotational axis 46 of roller cone drill bit 40. Various features of the present disclosure may be described with respect to bit rotational axis 46 of the roller cone drill bits 40. See FIG. 3.

Each cone assembly 60 may include a respective backface 62 having a generally circular configuration. A cavity (not expressly shown) may be formed in each cone assembly 60 extending through associated backface 62. Each cavity may be sized to receive associated spindle 82. Various types of bearings, bearing surfaces, ball retainers and/or seal assemblies may be disposed between interior portions of each cavity and exterior portions of associated spindle 82.

For some applications a plurality of milled teeth 64 may be formed on exterior portions of each cone assembly 60. Milled teeth 64 may be arranged in respective rows. A gauge row of milled teeth 64 may be disposed adjacent to backface 62 of each cone assembly 60. The gauge row may sometimes be referred to as the "first row" of milled teeth 64. Other types of cone assemblies may be satisfactorily used with the present disclosure including, but not limited to, cone assemblies having inserts and compacts (not expressly shown) disposed on exterior surfaces thereof.

For some applications milled teeth 64 may include one or more layers of hard, abrasive materials (not expressly shown). Such layers may be referred to as "hard facing." Examples of hard materials which may be satisfactorily used to form hard facing include various metal alloys and cements such as metal borides, metal carbides, metal oxides and metal nitrides.

As shown in FIGS. 1 and 2, drill string 24 may apply weight to and rotate roller cone drill bit 40 to form wellbore 30. Inside diameter or sidewall 31 of wellbore 30 may correspond approximately with the combined outside diameter of cone assemblies 60 extending from roller cone drill bit 40. In addition to rotating and applying weight to roller cone drill bit 40, drill string 24 may provide a conduit for communicating drilling fluids and other fluids from well surface 22 to drill bit 40 at end 36 of wellbore 30. Such drilling fluids may be directed to flow from drill string 24 to respective nozzles 56 provided in roller cone drill bit 40.

Bit body 50 will often be substantially covered by a mixture of drilling fluid, formation cuttings and other downhole debris while drilling string 24 rotates roller cone drill bit 40. Drilling fluid exiting from nozzles 56 may be directed to flow generally downwardly between adjacent cone assemblies 60 and flow under and around lower portions of each cone assembly 60 trailing associated nozzle 56.

Roller cone drill bit 40 may have three substantially identical nozzles 56. For purposes of describing various features of the present disclosure nozzles 56 may sometimes be designated 56*a*, 56*b* and 56*c*. Respective fluid streams 120 exiting from nozzles 56*a*, 56*b* and 56*c* may sometimes be designated 120*a*, 120*b* and 120*c*.

Formation cuttings formed by roller cone drill bit 40 and any other downhole debris at end 36 of wellbore 30 will mix with respective fluid streams 120 exiting from each nozzle 56. Resulting flow streams 122 may be a mixture of drilling fluid, formation cuttings and other downhole debris. For purposes of describing various features of the present disclosure flow streams 122 associated with each nozzle 56*a*, 56*b* and 56*c* may be designated flow streams 122*a*, 122*b* and 122*c*.

Fluid stream or jet stream 120*a* is shown in FIG. 2 exiting from associated nozzle 56*a* and flowing around trailing cutter cone assembly 60. Fluid stream 120*a* exiting from nozzle 56*a* may be relatively free from particulate matter such as formation cuttings. As fluid stream 120*a* contacts portions of bottom hole 36, the concentration of particulate matter (formation cuttings and downhole debris) may substantially increase. The resulting flow stream 122*a* of drilling fluid and particulate matter is shown wrapping around bottom hole assembly 26 and drill string 24 above roller cone drill bit 40. As discussed later in more detail, lifting surfaces 100 disposed on respective support arms 80 may assist with forming spiraling fluid flow in annulus 34 above drill bit 40.

Flow steam 122*c* associated with nozzle 56*c* is also shown in FIG. 2. Third flow stream 122*b* associated with nozzle 56*b* would also be present in an actual downhole environment. However, flow stream 122*b* is not shown in FIG. 2 to better highlight characteristics of flow streams 122*a* and 122*c*.

Each support arm 80 may include respective exterior surfaces 84 and an interior surface (not expressly shown) with spindle 82 attached thereto and extending therefrom. Each support arm 80 may also include leading edge 86 and trailing edge 88 with exterior surface 84 disposed therebetween. Exterior portion 84 may sometimes be referred to as a "shirttail." Extreme end 90 of each support arm 80 opposite from upper portion 42 of bit body 50 may sometimes be referred to as a "shirttail tip."

Respective lifting surface 100 may be formed on exterior portion 84 of each support arm 80 spaced from associated shirttail tip 90. Each lifting surface 100 may be disposed proximate an upper edge of associated exterior surface 84. Each lifting surface 100 may be generally described as having inlet 102 and outlet 104. Inlet 102 may be disposed adjacent to leading edge 86 of support arm 80. Outlet 104 may be disposed adjacent to trailing edge 88 of support arm 80.

For some applications leading edge 86 of each support arm 80 may include enlarged surface 86*a* forming a portion of associated inlet 102. Surfaces 86*a* may be relatively smooth corresponding approximately with associated lifting surfaces 100. Surfaces 86*a* may have a width approximately equal to the width of lifting surfaces 100 at respective inlets 102. Surfaces 86*a* may have generally sloped configurations relative to respective inlets 102 to assist with directing fluid carrying formation cuttings (flow streams 122) and other downhole debris up and over associated lifting surfaces 100. See FIGS. 2 and 5.

For some applications trailing edge 88 of each support arm 80 may include enlarged surface 88*a* forming a portion of associated outlet 104. Surfaces 88*a* may be relatively smooth corresponding approximately with associated lifting surfaces 100. The width of surfaces 88*a* may be approximately equal to the width of surfaces 100 at respective outlets 104. Surfaces 88*a* may have generally vertical orientations relative to respective outlets 104 to encourage separation of associated flow streams 122 from associated lifting surfaces 100 and upward spiraling flow in well annulus 34. For some embodiments the configuration of each surface 88*a* may be further modified to cooperate with associated trailing surface 86*a* to provide an enlarged flow area for associated flow stream 122 to flow upward from end 36 of wellbore 30 and over trailing lifting surface 100.

Each lifting surface 100 may have a generally upward inclination relative to exterior surface 84 of respective support arm 80 and bit rotational axis 46. For some embodiments outlet 104 of each lifting surface 100 may be located proximate a transition between bit body 50 and upper portion 42. The configuration and dimensions of each lifting surface 100 including associated inlet 102 and outlet 104 may be selected to assist in forming respective fluid stream 122 having a generally upward spiral in associated well annulus 34.

For some applications each support arm 80 may include a generally wedge shaped portion 110 disposed proximate trailing edge 88 and outlet 104 of lifting surface 100. As a result, exterior surface 84 of support arm 88 may have a generally asymmetrical configuration such as shown in FIG. 5. Providing generally wedge shaped portion 110 on each support arm 80 allows optimizing the configuration and design of associated lifting surface 100 to provide desired lift for fluid flowing over lifting surface 100. Also, the increased dimensions associated with forming wedge shaped portion 110 on each support arm 80 provides greater flexibility in designing the location, size and orientation of nozzle receptacles or nozzle housings 54. As a result, the location and orientation of each nozzle 56 may be better optimized to direct respective fluid stream 120 exiting therefrom. For some applications fluid stream 120 exiting from nozzle 56 will flow beneath the crest of milled teeth 64 on the gage row of trailing cone assembly 60. The fluid stream 120 will flow between milled teeth 64 and bottom or end 36 of wellbore 30.

The location of each nozzle 56 on roller cone drill bit 40 and the direction of a respective stream of drilling fluid exiting from each nozzle 56 may be selected to enhance drilling efficiency of roller cone drill bit 40. Nozzles 56 associated with roller cone drill bit 40 may cooperate with each other and with associated lifting surfaces 100 to produce a generally smooth, upward spiral of drilling fluid flow mixed with formation cuttings and other downhole debris from end or bottom 36 of wellbore 30 to associated well surface 22. Lifting surfaces 100 may produce relatively stable swirling patterns within well annulus 34. Such swirling patterns may organize fluid flow within well annulus 34 to help reduce hydraulic losses and more quickly remove formation cuttings generated by roller cone drill bit 40 from the end or bottom of wellbore 30.

For some applications, a relatively steep ascending swirling motion in well annulus 34 may increase overall hydrodynamic efficiency of a roller cone drill bit and associated fluid systems. An ascending upward swirling motion may generally accelerate removal of formation cuttings and other downhole debris from the end of a wellbore and may result in an increased rate of penetration for an associated roller cone drill bit.

Optimum dimensions, configuration orientation of lifting surfaces 100 including inlets 102 and outlets 104 may be determined in accordance with teachings of the present disclosure. For example the configuration and dimensions of lifting surfaces 100 may be based upon creating a strong upward swirling motion and eliminating or reducing areas of stagnant fluid flow between cutting structures of an associated roller cone drill bit and the bottom or end of a wellbore. A spiraling flow path of at least one inch of lift per three hundred and sixty degrees of rotation may be provided.

For some applications mixtures of drilling fluid, formation cuttings and other downhole debris may follow in a generally spiraling flow path defined in part by a fluid stream which wraps around drill string 24 approximately three times per foot. The optimum number of spiraling wraps may vary based on downhole drilling conditions including, but not limited to, the type of formation cuttings, characteristics of the drilling fluid and associated well annulus. A single wrap of drilling fluid flow streams 122 such as shown in FIG. 2 may travel approximately three hundred sixty degrees relative to the exterior of drill string 24.

Each support arm 80, associated lifting surface 100 and cutter cone assembly 60 may have substantially the same overall configuration and dimensions. For purposes of describing various features of the present disclosure support arms 80, lifting surfaces 100, cone assemblies 60 and nozzles 56 have been designated with a, b and c in FIG. 4.

Roller cone drill bits are generally rotated to the right during formation of a wellbore. Therefore, support arm 80*a* and associated cone assembly 60*a* may be generally described as "leading" with respect to support arm 80*b* and associated cone assembly 60*b*. In the same respect, support arm 80*a* and associated cone assembly 60*a* may be described as "trailing" with respect to support arm 80*c* and associated cone assembly 60*c*.

Fluid stream 120*a* exiting from nozzle 56*a* associated with support arm 80*a* will preferably flow generally downward and under milled teeth 64 on the gage row of trailing cone assembly 60*b*. Fluid stream 120*a* will pick up formation cuttings and other downhole debris from the end of wellbore 30. The resulting flow stream 120*a* will then flow generally upwardly through an enlarged area formed between trailing edge 88 of support arm 80*b* and leading edge 86 of support arm 80*c*. Surface 86*a* formed on leading edge 86 of support arm 80*c* will provide an increased flow area for associated flow stream 120*a* to flow upwardly through inlet 102 and over lifting surface 100*c*. This same pattern of respective fluid streams 120*b* and 120*c* exiting from nozzles 56*b* and 56*c* and flowing under respective cone assemblies 60*c* and 60*a* and over respective lifting surfaces 100*a* and 100*b* will be repeated to form spiraling flow paths or flow stream 122*b* (not expressly shown) and 122*c*. See FIG. 2.

For some applications shirttail or exterior surface 84 of each support arm 80 may be disposed relatively close to adjacent portions of sidewall or inside diameter 31 of wellbore 30. For such applications exterior surface or shirttail 84 may taper approximately one or two degrees away from adjacent portions of sidewall 31. A typical spacing between sidewall 31 and exterior 84 of each support arm 80 may be approximately 0.100 inches. As a result of this spacing, a plurality of inserts or compacts (not expressly shown) may be provided in the exterior surface 84 of each support arm 80 adjacent to respective leading edge 86 and/or trailing edge 88.

Holes or indentation 106 as shown in FIG. 5 may be provided for installing associated compacts or inserts. For embodiments such as shown in FIG. 5, one or more layers of hard facing material (not expressly shown) may be added to exterior portions of support arm 84 indicated by dotted lines 108*a*-108*d*.

Various techniques and procedures may be satisfactorily used to rotatably engage each cone assembly 60 with respective spindle 82. For embodiments represented by support arm 80, ball retainer opening 92 may be formed in exterior surface 84. Ball retainer opening 92 may be generally aligned with a ball retainer passageway (not expressly shown) extending through portions of associated spindle 82. A ball retainer groove (not expressly shown) may also be formed in the exterior of spindle 82 and interior portions of the cavity formed in cone assembly 60. Various types of engagement mechanisms and techniques may be used to insert balls through opening 92 and a retainer plug may be disposed therein to rotatably engage each cone assembly 60 with associated spindle 82.

For some applications lubricant reservoir 94 as indicated by dotted lines in FIG. 4 may be disposed within each support arm 80. Lubricant reservoir 94 and associated lubricant flow paths may be used to communicate lubricant with bearing surfaces disposed between cone assembly 60 and respective spindle 82. The lubricating fluid may also be used to prevent drilling fluid from entering into the cavity formed within each cone assembly 60. The location of opening 92 formed in exterior surface 84 of each support arm 80 would generally extend radially from associated bit rotational axis 46. As best shown in FIG. 5, each support arm 80 may have a generally asymmetrical configuration relative to bit rotational axis 46.

The Security DBS Drill Bits Technical Bulletin TB.09.06.01 (incorporated by reference herein) shows one example of a roller cone drill bit incorporating teachings of the present disclosure.

Although the present disclosure and its advantages have been described in detail, it should be understood that various changes, substitutions and alternations can be made herein without departing from the spirit and scope of the disclosure as defined by the following claims.

What is claimed is:

1. A roller cone drill bit operable to form a wellbore comprising:

a bit body having an upper direction, wherein the upper direction is the direction towards a drill string, and the bit body having an upper end operable for connection to the drill string;

at least one support arm extending from the bit body;

each support arm having a leading edge and a trailing edge;

a lubricant reservoir disposed within each support arm;

a respective shirttail portion formed as part of an exterior surface of each support arm;

a respective roller cone assembly rotatably mounted on an interior portion of each support arm opposite from the respective shirttail portion;

a lifting surface formed on each support arm adjacent an uppermost edge of the associated exterior surface;

each lifting surface extending between the leading edge and the trailing edge of the respective support arm and having an upward inclination relative to the exterior surface;

an enlarged surface formed adjacent the leading edge and the lifting surface, the enlarged surface having a sloped configuration to assist in directing drilling fluid and formation cuttings over the lifting surface; and the lifting surfaces cooperating with each other to direct drilling fluid and formation cuttings upwardly in spiraling flow paths relative to an associated drill string and wellbore.

2. The drill bit of claim 1, further comprising a respective wedge shaped portion disposed on each support arm.

3. The drill bit of claim 1, further comprising each support arm having a nonsymmetrical exterior surface.

4. The drill bit of claim 1 wherein each lifting surface comprises a generally concave surface.

5. The drill bit of claim 1 further comprising a wedge shape portion formed proximate the trailing edge and the lifting surface of each support arm.

6. The drill bit of claim 1 further comprising:

an inlet surface formed on the leading edge of each support arm; and each inlet surface operable to communicate drilling fluid and formation cuttings with the associated lifting surface.

7. The drill bit of claim 1 further comprising:

the shirttail portion of each support arm defined in part by a radius approximately equal to the radius of a wellbore formed by the roller cone drill bit, such that a spacing between a side wall of the wellbore and the shirttail portion of each support arm is approximately 0.1 inches; and close spacing between the shirttail portion of each support arm and adjacent portions of the wellbore cooperating to direct drilling fluid and formation cuttings toward the associated lifting surfaces.

8. The drill bit of claim 1 further comprising the lifting surfaces of the support arms cooperating with each other to direct drilling fluid and formation cuttings in a spiraling flow path with approximately four inches of lift per three hundred sixty degrees of rotation relative to an associated roller cone drill bit.

9. The drill bit of claim 1 wherein each cone assembly further comprises a plurality of cutting elements disposed in exterior portions of the cone assembly.

10. The drill bit of claim 1, wherein each cutter cone assembly further comprises a plurality of milled teeth.

11. A support arm for a roller cone drill bit having a bit body and an associated bit rotational axis, comprising:

the support arm having an upper direction, wherein the upper direction is the direction towards a drill string;

the support arm having a leading edge, a trailing edge and an exterior surface disposed thereon;

a lubricant reservoir disposed within each support arm;

a shirttail portion formed as part of the exterior surface of the support arm;

a respective cone assembly mounted on an interior portion of the support arm with the cone assembly projecting generally downwardly and inwardly relative to the support arm;

a lifting surface formed on the support arm adjacent an uppermost edge of the exterior surface;

the lifting surface extending between the leading edge and the trailing edge of the support arm;

the lifting surface having a relatively upward inclination relative to the exterior surface of the support arm and the associated bit rotational axis; and a wedge shaped portion formed proximate the trailing edge and the lifting surface of the support arm, the wedge shaped portion having a sloped configuration to assist in directing drilling fluid and formation cuttings over the lifting surface.

12. The support arm of claim 11, and further comprising:

a nozzle disposed proximate the wedge shaped portion;

the nozzle having an exit operable to direct drilling fluid therefrom; and fluid exiting from the nozzle operable to cooperate with the lifting surface to generate a spiraling fluid path in an associated well annulus.

13. The support arm of claim 11, further comprising the lifting surface defining an upper edge for the shirttail portion of the support arm.

14. The support arm of claim 11, further comprising a plurality of inserts disposed on the shirttail portion adjacent to the leading edge and the trailing edge.

15. The support arm of claim 11, wherein the lifting surface comprises an approximately linear slope from the leading edge to the trailing edge of the support arm.

16. The support arm of claim 11, further comprising the lifting surface operable to direct drilling fluid and formation cuttings in a spiraling flow path having at least one inch of lift per three hundred sixty degrees of rotation of the roller cone drill bit.

17. The support arm of claim 11, further comprising:

the shirttail portion of the support arm wherein a diameter of the shirttail portion of the support arm is approximately equal to a maximum diameter of the roller cone drill bit, and thus a radius of a wellbore formed by the roller cone drill; and a spacing between a side wall of the wellbore and the shirttail portion of each support arm is approximately 0.1 inches;

such that as the roller cone drill bit forms a wellbore, drilling fluids and formation cuttings will be forced to flow over the lifting surface and away from the cone assembly.

18. The support arm of claim 11, comprising an inlet surface formed along the leading edge of the support arm to aid in directing drilling fluid and formation cuttings toward the lifting surface.

19. The support arm of claim 11, wherein the cone assembly further comprises a plurality of cutting elements disposed therein.

20. The support arm of claim 11, wherein the cone assembly further comprises a plurality of milled teeth.

21. A roller cone drill bit having a bit body comprising:

the bit body having an upper direction, wherein the upper direction is the direction towards a drill string, and the bit body having an upper end operable for attachment to the drill string;

three support arms extending from the bit body;

each support arm having a leading edge, a trailing edge and an exterior surface disposed therebetween;

a lubricant reservoir disposed within each support arm;

a respective shirttail portion formed as part of the exterior surface of each support arm, wherein a spacing between a side wall of the wellbore and the shirttail portion of each support arm is approximately 0.1 inches;

a respective spindle attached to an interior portion of each support arm opposite from the respective shirttail portion;

a respective roller cone assembly rotatably mounted on each spindle with each roller cone assembly projecting generally downwardly and inwardly from the respective support arm;

a lifting surface formed of each support arm adjacent an uppermost edge of the respective support arm;

each lifting surface extending between the leading edge of the respective support arm and the trailing edge of the respective support arm;

each lifting surface having a relatively upward inclination relative to the exterior surface of the respective support arm;

an inlet surface formed on the leading edge of each support arm;

each inlet surface operable to communicate drilling fluid and formation cuttings with the associated lifting surface;

the lifting surfaces cooperating with each other to direct drilling fluid and formation cuttings upwardly in an associated wellbore; and a respective wedge shaped portion formed proximate the trailing edge and the upper surface of each support arm, the wedge shaped portion having a sloped configuration to assist in directing drilling fluid and formation cuttings over the lifting surface.

22. The roller cone drill bit of claim 21 further comprising:

a respective nozzle disposed proximate each wedge shaped portion;

each nozzle having an exit operable to direct drilling fluid therefrom; and fluid exiting from each nozzle operable to cooperate with the lifting surfaces to generate spiraling fluid paths in an associated well annulus.

* * * * *